US006955224B2

(12) United States Patent
Watson

(10) Patent No.: US 6,955,224 B2
(45) Date of Patent: Oct. 18, 2005

(54) CASING ALIGNMENT TOOL

(76) Inventor: Philip K. Watson, 14 Dallas Dr., Houma, LA (US) 70360

( * ) Notice: Subject to any disclaimer, the term of this patent is extended or adjusted under 35 U.S.C. 154(b) by 159 days.

(21) Appl. No.: 10/659,500

(22) Filed: Sep. 10, 2003

(65) Prior Publication Data

US 2005/0051325 A1 Mar. 10, 2005

(51) Int. Cl.[7] ..... E21B 19/22
(52) U.S. Cl. ..... 166/379; 166/85.5
(58) Field of Search ..... 166/379, 380, 166/77.1, 77.51, 85.1, 85.5

(56) References Cited

U.S. PATENT DOCUMENTS 1,463,648 A 7/1923 Duley
4,016,637 A * 4/1977 Swensen ..... 29/281.4
4,213,237 A 7/1980 Whiting
4,440,220 A 4/1984 McArthur
4,599,778 A 7/1986 Dreyfuss et al.
4,681,158 A * 7/1987 Pennison ..... 166/77.51
5,806,589 A * 9/1998 Lang ..... 166/77.53
5,984,025 A 11/1999 Phillips
5,992,801 A 11/1999 Torres
6,360,633 B2 3/2002 Pietras
6,488,094 B1 * 12/2002 McDowell ..... 166/379
6,494,273 B1 12/2002 Martin
6,827,143 B2 * 12/2004 McGuffin et al. ..... 166/77.51

* cited by examiner

*Primary Examiner*—William Neuder
(74) *Attorney, Agent, or Firm*—Keaty Professional Law Corporation

(57) ABSTRACT

A casing alignment tool detachably mounts on a wellhead flange for moving a section of a casing into a concentric alignment with the wellhead of a well bore. The tool has a base plate attachable to the flange and a perpendicularly extending back plate, which supports a hydraulic jack or a winch. In the embodiment having a hydraulic jack, the tool provides for a V-block assembly with spread arms for pushing against the casing when the hydraulic jack is operated. In the embodiment using a winch, one or more flexible, non-stretchable bands are provided for wrapping around the casing and pulling the casing into alignment, with the flange acting as a fulcrum.

15 Claims, 6 Drawing Sheets

CASING ALIGNMENT TOOL

BACKGROUND OF THE INVENTION

This invention relates to production well completion and, more particularly, to a tool for aligning casing in relation to a wellhead in an oil or gas drilled well bore.

After a well bore is drilled, it is conventional to position a casing in the well bore to protect the wall of the drilled well bore and ensure that production pipes can be safely positioned in the well bore. The casing is lowered into the well on a set of slips that grip and hold it in position in relation to the wellhead. In order for the slips to be properly positioned around the casing, it is necessary to center the casing inside the wellhead so that the center of the well bore and the center of the casing are concentrically aligned. Casing hanger slips are used to hold up the casing and cement the casing inside the well bore.

A casing section is a hollow tubular body having 40 or more feet in length and from 4 to 20 inches in diameter. The casing sections are threaded together to extend into the well bore and prepare the drill hole for production of oil, gas, water, or other natural resources. Once the casing hanger slips are set and the excess casing is removed, if necessary, the casing adapter spool is added on top of the wellhead and bolted down tight. The structure forms the bottom of a Christmas tree, through which the natural resources are delivered to the surface. Drilling then continues until another hanger spacing is run to either complete the well or to isolate a zone that might cause problems in the drilling process. In all cases, the casing must be lined inside the well bore in order to connect it with another casing section so that drilling can continue and the well can be completed.

The task of casing alignment is even more complicated in an offshore location, where a large gap of approximately 90 feet exists between the wellhead on the ocean floor and the bottom of the offshore platform. The gap tends to cause bending of the casing pipe, which further complicates the problem. Rig personnel use chains and air tuggers to try to align the casing with the wellhead. This practice presents additional difficulties since the rig has only a limited number of fixed points, such as the legs of the derrick on which a cable can be secured to pull the casing into alignment. The personnel have to jury rig, at great danger to personnel on the rig, to try to align the casing and the wellhead to set the slips and proceed with the drilling operations. Valuable rig time is lost and the cost of the completion operation rises.

An additional problem is that the fixed points available on the rig are seldom located at points where the casing can be engaged and pulled into alignment. Still another obstacle is the limited distance that the casing can be moved in the rotary table.

The present invention contemplates elimination of drawbacks associated with conventional methods and provision of a casing alignment tool that can be set up and moved to operation in a relatively short time, thereby saving the expense and improving safety conditions on the drilling rig.

SUMMARY OF THE INVENTION

It is, therefore, an object of the present invention to provide a casing alignment tool that can be used for alignment of vertical casing pipes inside a well bore to move the casing into concentric alignment with the well head.

It is another object of the present invention to provide a casing alignment tool that is easy to use and inexpensive to manufacture.

These and other objects of the present invention are achieved through a provision of a casing alignment tool adapted for securing to an annular flange topping a wellhead. A base plate of the tool is adapted for detachable securing to the flange. The base plate carries a perpendicularly extending back plate that is concave to generally follow the curvature of the casing wall. The back plate supports a power means for urging the casing into a concentric alignment with the well bore.

In one of the embodiments, the power means is a hydraulic jack adjustably movable in relation to the back plate through the support of securing bolts moving with a horizontal slot formed in the back plate. A V-block, or Vee bock assembly extends between the hydraulic jack and the casing wall, transmitting a force having a vertical component to the casing, pushing the casing into a central position within the well bore.

In the second embodiment, the power means is one or more ratchet winches that carry flexible non-stretchable bands. The bands are wrapped around the casing and the winch is operated pulling against a fulcrum formed by the flange against the casing wall until the casing is properly aligned with the central vertical axis of the well bore.

The casing alignment tool of the present invention allows to inexpensively and expeditiously complete the casing alignment operation in preparation to positioning of the hanger slips and cementing of the casing.

BRIEF DESCRIPTION OF THE DRAWINGS

Reference will now be made to the drawings, wherein like parts are designated by like numerals, and wherein.

DETAILED DESCRIPTON OF THE PREFERRED EMBODIMENT

Figure 1:
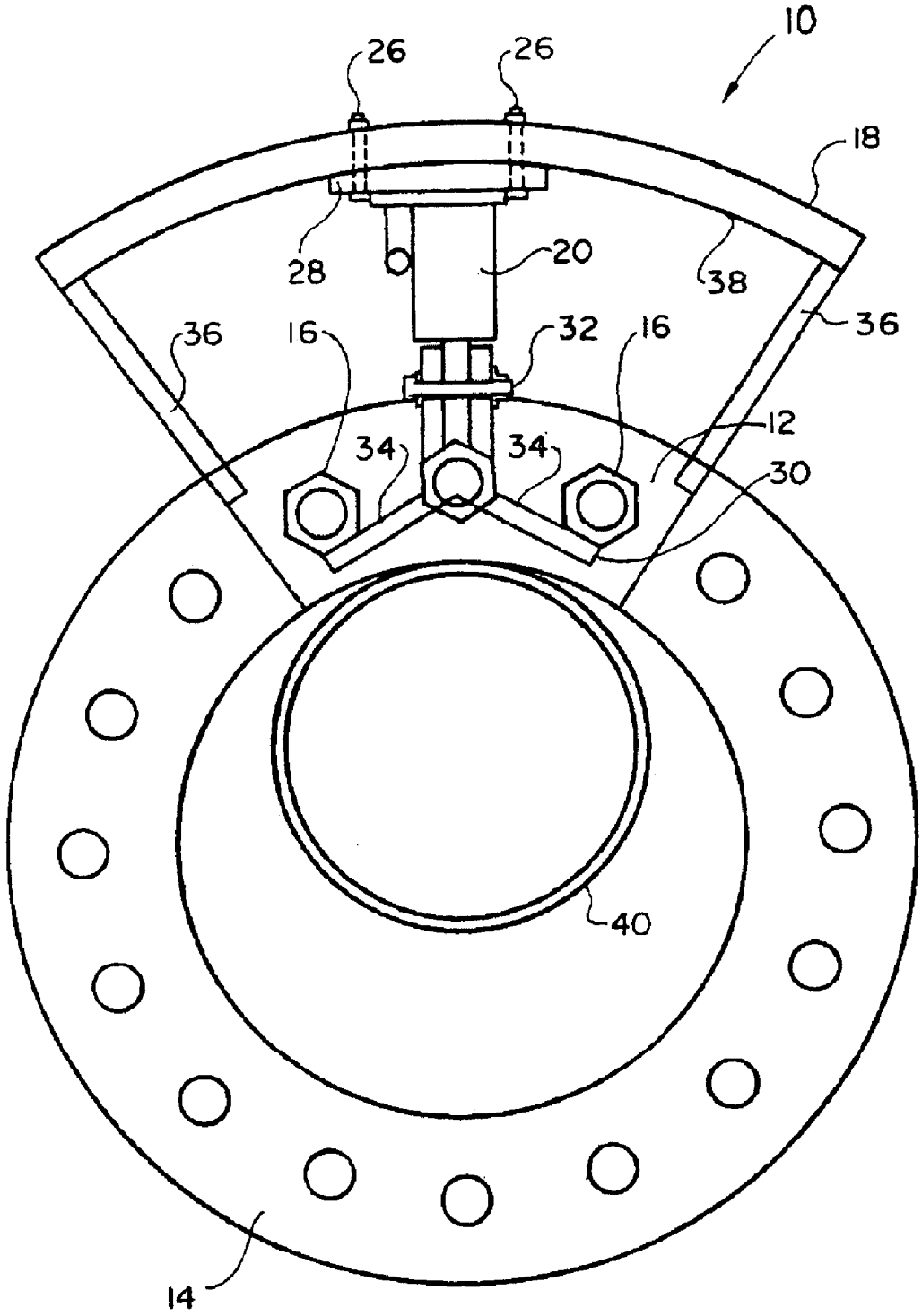
FIG. 1 is the top view of the casing alignment tool of the first embodiment of the present invention using a hydraulic jack.
Figure 2:
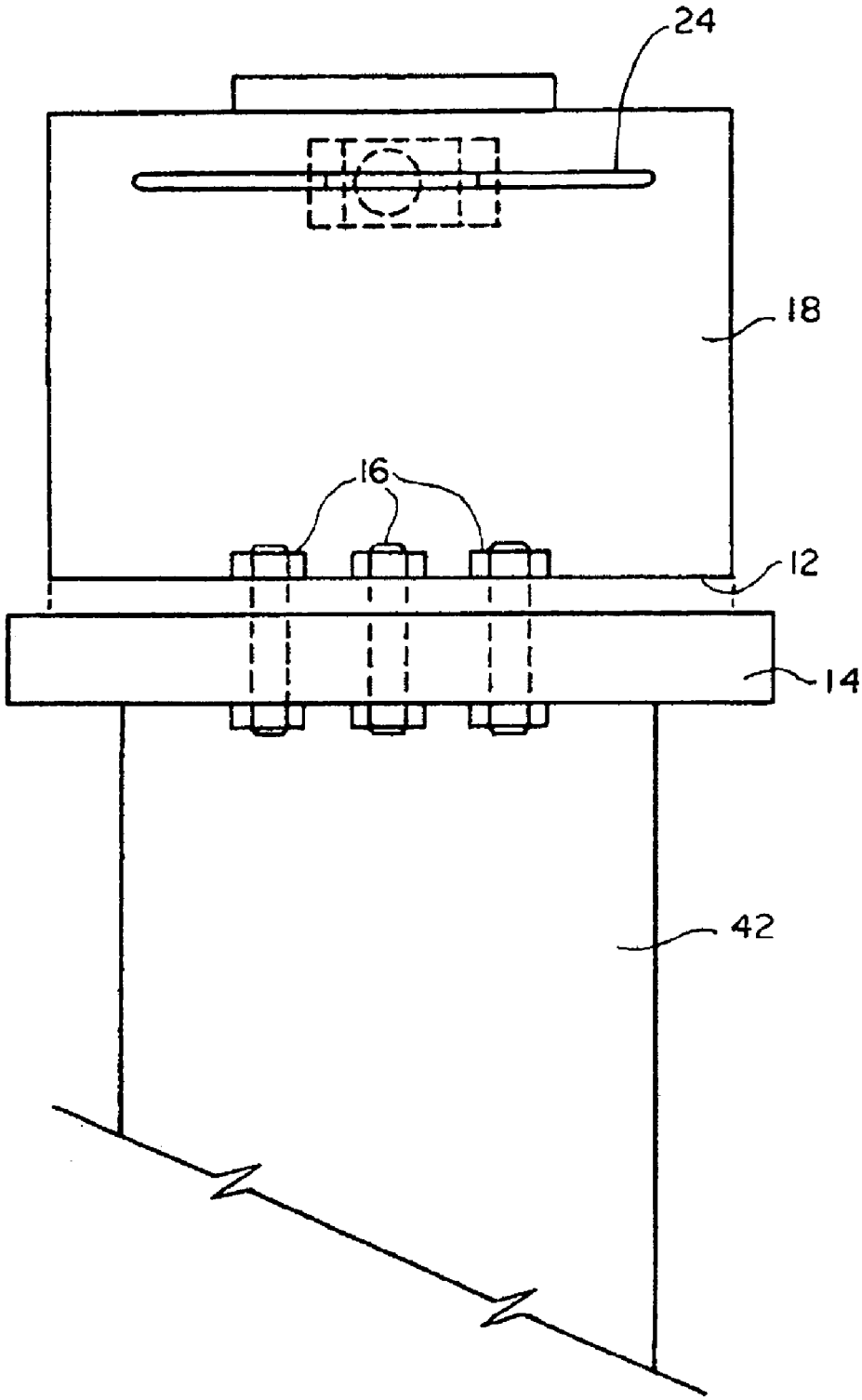
FIG. 2 is a side view of the casing alignment tool of FIG. 1.

Turning now to the drawings in more detail, numeral 10 designates a casing alignment tool according to the first embodiment of the present invention. As can be seen in the drawings, the tool 10 comprises a base plate 12 adapted for detachable securing to a wellhead top 14 by bolts 16 or other suitable securing means. The base plate 12 carries a back plate 18, which has a generally concave configuration, which generally follows the curvature of the wellhead flange 14.

A power means 20, which can be a hydraulic jack, is secured to the top portion 22 of the back plate 18. A slot 24 in the back plate allows securing bolts 26 to pass through the back plate 18 and retain the power unit 20 in a vertically spaced relationship to the base plate 12. A holder plate 28 is mounted behind the hydraulic jack 20 and is engaged by the bolt 26 for secure attachment of the hydraulic jack 20 to the back plate 18.

A V-block, or Vee block 30 is secured to the hydraulic jack 20 by bolt 32 or other suitable securing means. The V-block 30 comprises a pair of spread arms 34 arranged in a v-shaped configuration for engaging an exterior wall of a casing 40 positioned within a vertical well bore 42. A pair of gussets 36 is secured on top of the base plate 12 and to the inner wall 38 of the back plate 18. The gussets 36 provide structural strength and facilitate the right angle orientation between the base plate 12 and the back plate 18.

An optional distance limiting means, or distance indicator 44 (No-Go indicator 44), can be secured to the backside of the flange 14. The indicator 44 allows the operator to visually observe how far the casing 40 can be moved and when the central position of the casing 40 in relation to the central axis of the well bore 42 has been achieved. The distance limiting means 44 comprises an upright arcuate post, or column 45 secured to the flange 14 opposite the back plate 18. The column 45 carries a horizontally extending arm 47, which extends above the wellhead top 14. A distal end 49 of the arm 47 protrudes to a pre-determined distance above the wellhead 14, so that the casing 40 contacts the end 49 when the alignment position has been achieved. The arm 47 limits the distance, to which the casing 40 can be moved in the direction opposite from the back plate 18.

Figure 3:
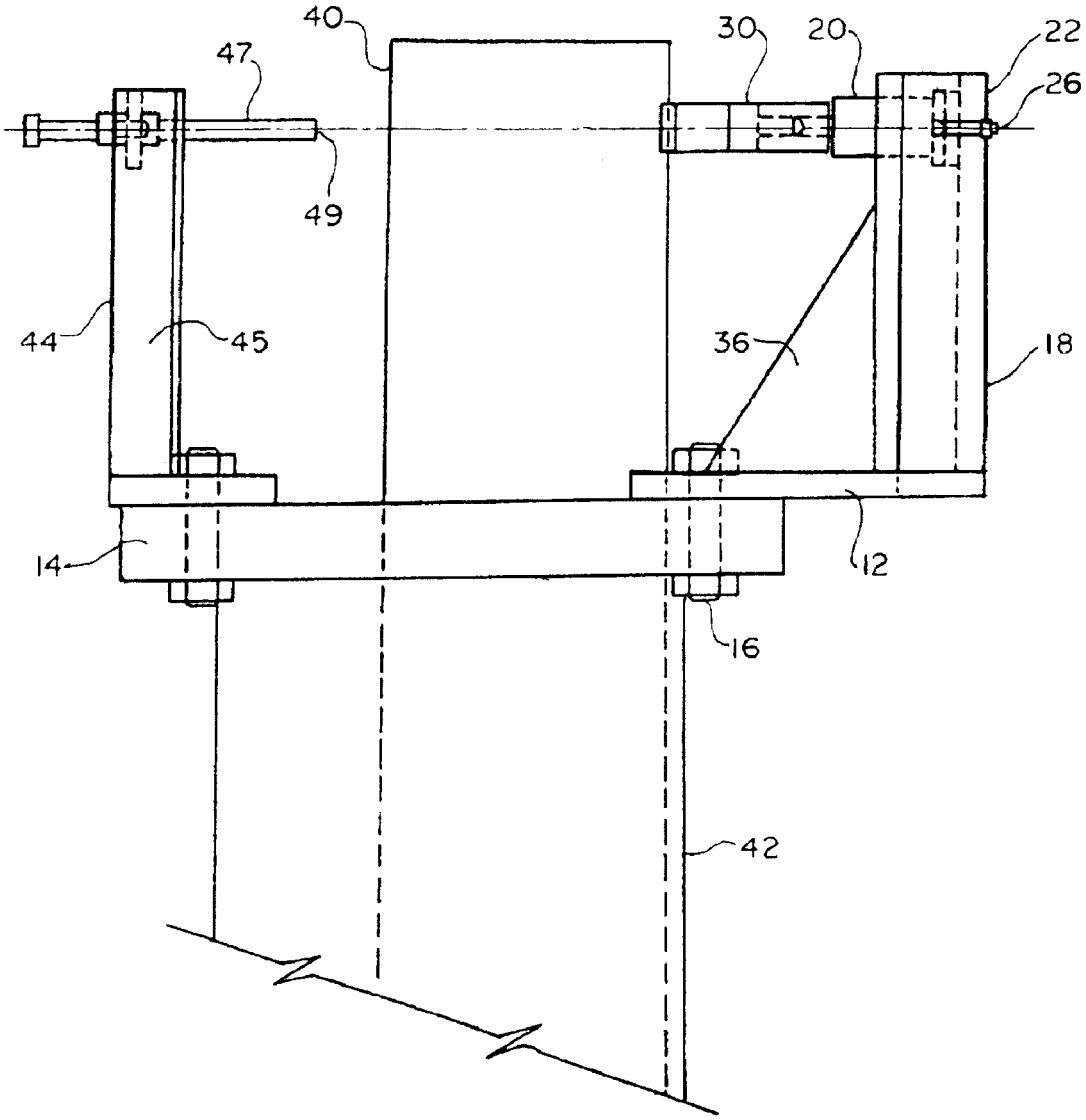
FIG. 3 is a front view of the casing alignment tool of the first embodiment of the present invention showing distance limitation device to the left of the casing.
Figure 4:
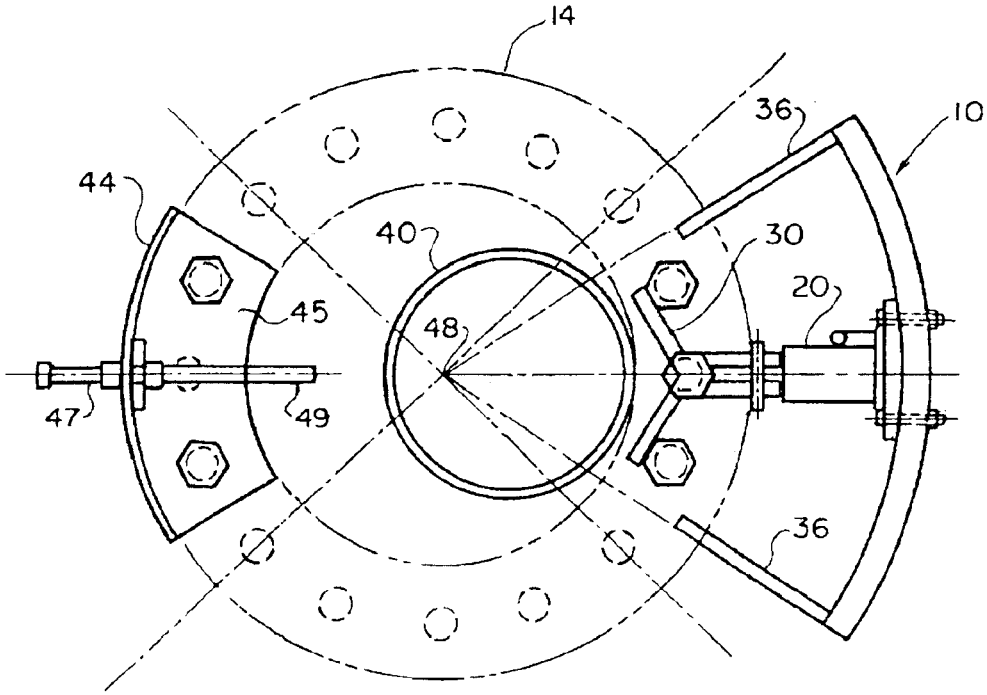
FIG. 4 is a top view of the hydraulically operated casing alignment tool of the first embodiment of the present invention showing the distance limitation device on the left.

In operation, the operator observes that the casing 40 is not in a concentric relationship with the central axis of the well bore 42 as shown schematically in FIGS. 1, 3, and 4. The operator then activates the hydraulic jack 20 to move the Vee block 30 into an engagement with an outside wall of the casing 40. The force of the power unit 20 has a horizontal and a vertical component, causing the casing 40 to move towards the center of the wellhead until the casing 40 contacts the end 49 of the arm and a desired alignment has been achieved.

The horizontal slot 24 formed in the back plate 18 allows for small adjustments in the jacking mechanism so as to align the Vee block 30 to fit into the exact position it needs to be to push the casing 40 towards the center of the wellhead 14.

Figure 5:
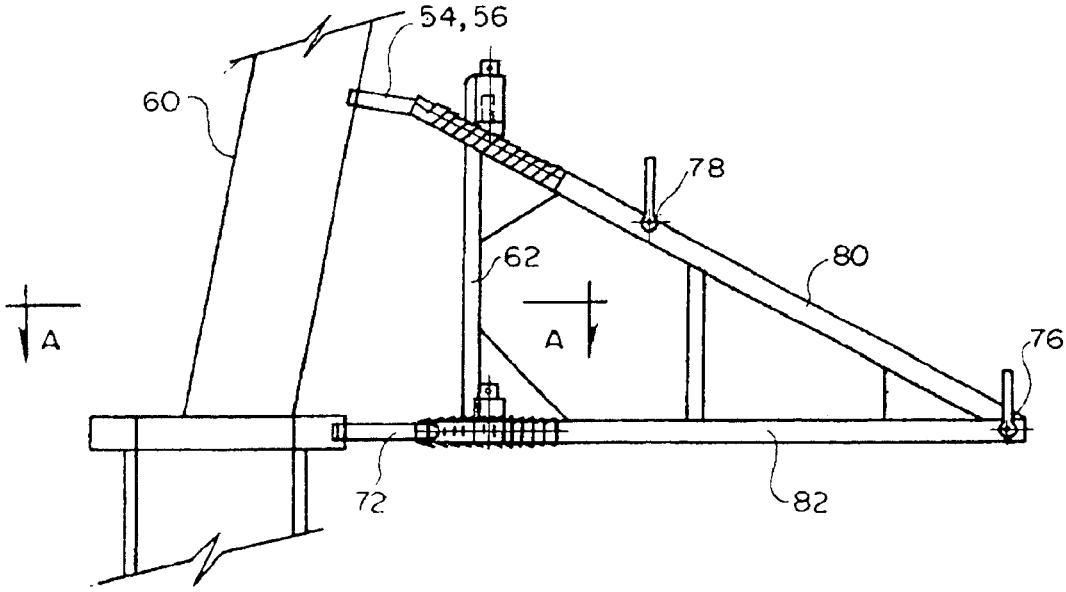
FIG. 5 is a lever-type casing alignment tool of the second embodiment of the present invention with pulling bands not shown for clarity.
Figure 6:
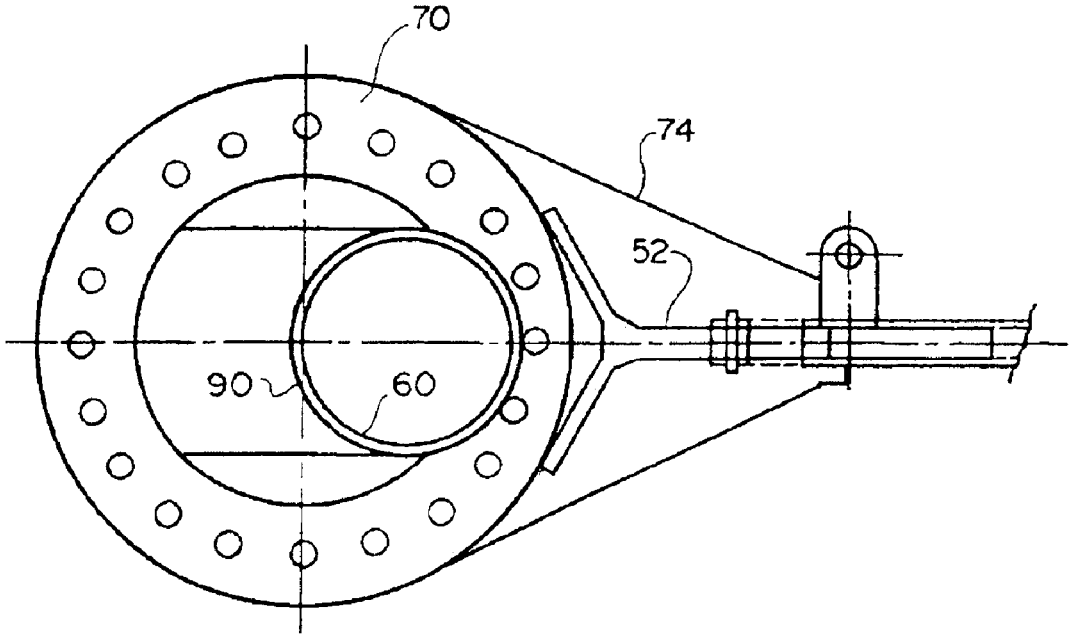
FIG. 6 is a sectional view taken along lines A—A of FIG. 5.
Figure 7:
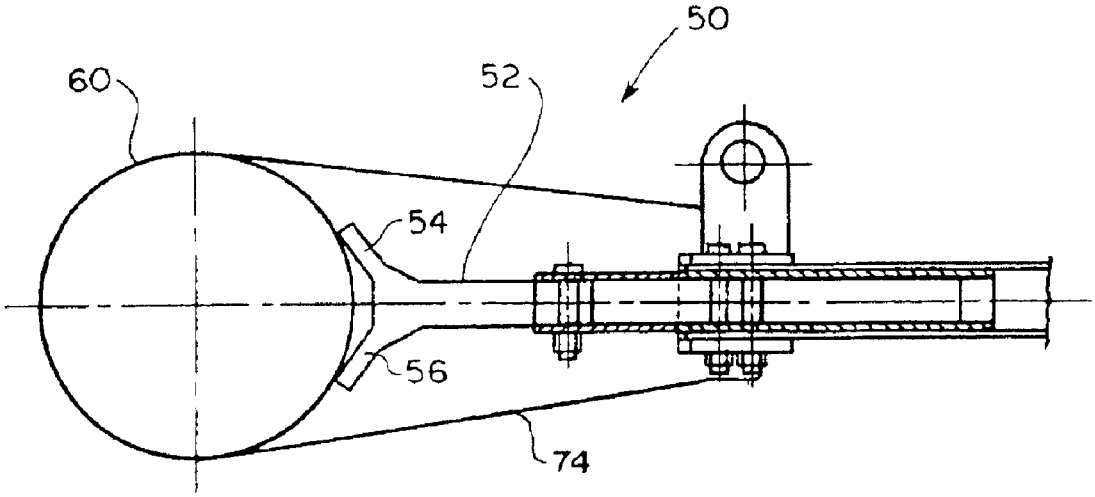
FIG. 7 is a top view of the lever-type casing alignment tool of the present invention with a V-block shown in a horizontal position for clarity.
Figure 8:
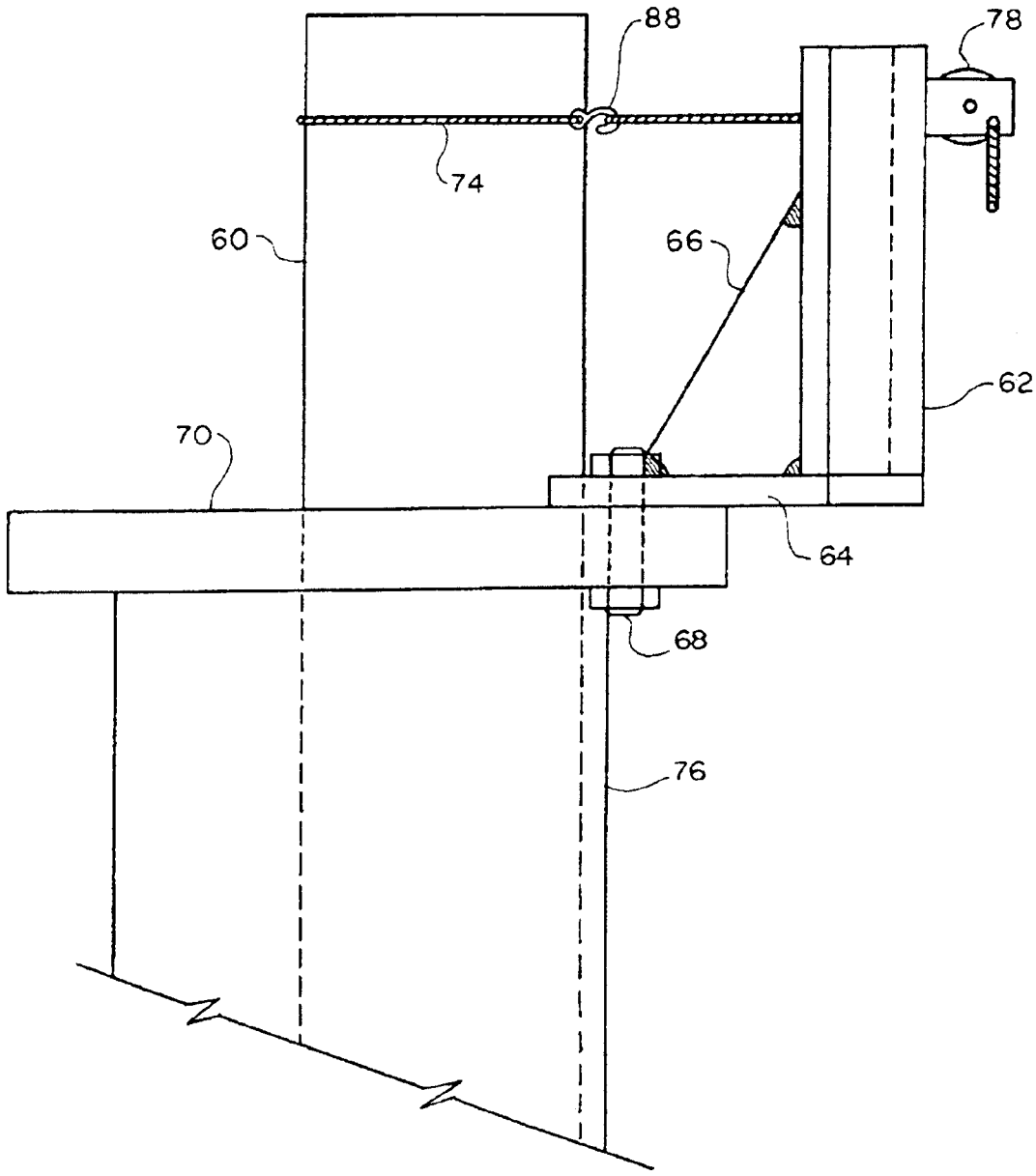
FIG. 8 is a front view of the casing alignment tool of the present invention using a hand operated ratchet winch.

Turning now to the second embodiment of the present invention illustrated in FIGS. 5–8, a lever type casing alignment tool is illustrated. As can be seen in the drawings, the casing alignment tool 50 is provided with a Vee block 52 which has a pair of arms 54 and 56 for contacting an outside of a casing 60. In this embodiment, the back plate 62 is secured at a right angle to a base plate 64 and is retained in that position with the assistance of gussets 66. Suitable bolts or other securing means 68 attach the base plate 64 to the wellhead flange 70. Alternatively, as shown in FIG. 5, a flexible, non-stretchable band 72 may be used for wrapping around the flange 70 and securing the back plate 62 to the base plate 64.

A second flexible, non-stretchable band 74 is wrapped around an upper part of the section of the casing 60. The straps 74 and 72 are tightened with respective hand operated ratchet winches 76 and 78. The two bands form the base of a right angle triangle, which is about 3 feet high. The other two sides of the triangle 80 and 82 extend 6 feet in length to form the lever. The wellhead flange acts as a fulcrum. By aligning the lever in relation to the casing 60, the operator tightens or pulls on the straps 72 and 74, causing the casing 60 to move towards the center 90 and align with the center 90 of a wellhead body 76. When applying the pulling action, the operator makes sure that the arms 54, 56 of the V-block 52 are oriented perpendicular in relation to the misaligned casing 60.

A slot (not shown) similar to the slot 24 may be made in the back plate 62. The winch 78 is fixedly attached to the back plate 62 and can be adjusted in position within the slot in the back plate 62 to properly pull the casing 60 to its central position. The wire rope of the winch can be wrapped around the casing, similar to the band 74 and hooked with a hook 88. By operating the winch 78, the operator pulls the casing 60 into the correct position within the well bore.

Once the casing is properly aligned, the casing slips can be set in place without a lot of jury-rigging and the drilling operations can continue. The casing alignment tools 10 or 50 can then be moved to align another section of the casing as the completion operations progress. The present invention allows aligning of casing sections within the well bore more easily then is possible with conventional methods. It is estimated that two personnel can install the casing alignment tools of the present invention in a short period of time and have the casing aligned properly much faster than is possible with today's known equipment and methods.

Many changes and modifications can be made in the design of the present invention without departing from the spirit thereof. I therefore pray that my rights to the present invention be limited only by the scope of the appended claims.

I claim:

1. A casing alignment tool for aligning a section of casing within a well bore topped with an annular flange, the tool comprising:

a base plate adapted for detachable securing to an upper surface of the flange:

a back plate extending at a right angle to the base plate;

a means carried by the back plate for engaging an exterior wall of the casing and applying a force having a vertical component to the casing to thereby cause a central axis of the casing to substantially align with a central axis of the well bore, wherein said force applying means comprises a power means secured to an upper portion of the back plate and a casing engaging member operationally connected to the power means for transmitting the force generated by the power means to the casing; and said power means is a hydraulic jack.

2. The tool of claim 1, wherein said casing engaging member comprises a Vee block assembly provided with a pair of arms adapted to urge against the exterior wall of the casing.

3. The tool of claim 2, wherein said Vee block is adapted for engaging the casing exterior wall at a substantially right angle.

4. The tool of claim 3, further comprising a second flexible non-stretchable band extending between the base plate and the flange.

5. The tool of claim 1, further comprising a means for limiting movement of the casing along a horizontal plane.

6. The tool of claim 4, wherein said movement limiting means comprises a distance indicator detachably mounted on the annular flange opposite said base plate.

7. The tool of claim 5, wherein said distance indicator comprises an upwardly extending post secured to the annular flange and an arm extending perpendicularly to said post, a distal end of said arm limiting movement of the casing within the well bore.

8. The tool of claim 1, further comprising a means for adjusting position of the force applying means in relation to the casing.

9. The tool of claim 8, wherein said means fur adjusting position comprises a slot formed in the back plate and wherein said force applying means comprises an attachment member moving in said slot.

10. The tool of claim 1, further comprising a means for retaining said back plate in a generally perpendicular position in relation to the base plate.

11. The tool of claim 9, wherein said retaining means comprises a pair of gussets attached to the base pate and the back plate.

12. A casing alignment tool for aligning a section of casing within a well bore topped with an annular flange, the tool comprising:

a base plate detachably secured to an upper surface of the flange;

a back plate extending at a right angle to the base plate;

a power means carried by the back plate, said power means comprising a hydraulic jack secured to an upper portion of the back plate; and a casing engaging member supported by the power means for engaging an exterior wall of the casing and applying a force having a vertical component to the casing to thereby cause a central axis of the casing to substantially align with a central axis of the well bore.

13. The tool of claim 12, wherein said casing engaging member comprises a V-block assembly provided with a pair of arms for urging against the casing exterior wall when the power means is operated.

14. The tool of claim 12, wherein said casing engaging means comprises a flexible non-stretchable band extending from said winch and wrapped around the casing exterior wall, said band being adapted to being tightened by the winch, thereby transmitting a straightening force on the casing.

15. The tool of claim 14, further comprising a second winch and a second flexible non-stretchable band extended between the second winch and the annular flange, with the annular flange acting as a fulcrum for the power means acting on the casing exterior wall.

* * * * *